US011533988B2

(12) United States Patent
Walls et al.

(10) Patent No.: US 11,533,988 B2
(45) Date of Patent: Dec. 27, 2022

(54) SYSTEMS AND METHODS FOR LIFT FORCE ESTIMATION

(71) Applicant: Ergotron, Inc., St. Paul, MN (US)

(72) Inventors: Peter Lee LaFleur Walls, Saint Paul, MN (US); Jeffrey Randall Mensing, Eden Prairie, MN (US); Mustafa Ergun, Eden Prairie, MN (US)

(73) Assignee: Ergotron, Inc., St. Paul, MN (US)

( * ) Notice: Subject to any disclaimer, the term of this patent is extended or adjusted under 35 U.S.C. 154(b) by 0 days.

(21) Appl. No.: 17/292,927

(22) PCT Filed: Oct. 27, 2020

(86) PCT No.: PCT/US2020/057523

§ 371 (c)(1),
(2) Date: May 11, 2021

(87) PCT Pub. No.: WO2021/086849

PCT Pub. Date: May 6, 2021

(65) Prior Publication Data

US 2022/0265038 A1 Aug. 25, 2022

Related U.S. Application Data

(60) Provisional application No. 62/926,715, filed on Oct. 28, 2019.

(51) Int. Cl.
*A47B 9/02* (2006.01)
*A47B 21/02* (2006.01)

(52) U.S. Cl.
CPC ..... *A47B 9/02* (2013.01); *A47B 21/02* (2013.01); *A47B 2200/0052* (2013.01); *A47B 2200/0076* (2013.01)

(58) Field of Classification Search
CPC ... A47B 9/02; A47B 21/02; A47B 2200/0076; A47B 2200/0052
(Continued)

(56) References Cited

U.S. PATENT DOCUMENTS 3,657,691 A 4/1972 Wilentchik
3,815,076 A 6/1974 Aoki
(Continued)

FOREIGN PATENT DOCUMENTS

CN 203659562 6/2014
CN 108565085 A 9/2018
(Continued)

OTHER PUBLICATIONS

"International Application Serial No. PCT/US2020/057523, International Search Report dated Jan. 26, 2021", 2 pgs.
(Continued)

*Primary Examiner* — Jose V Chen
(74) *Attorney, Agent, or Firm* — Schwegman Lundberg & Woessner, P.A.

(57) ABSTRACT

A lift force of a height adjustable assembly can be estimated using a potentiometer or other position sensor coupled to a counterbalance mechanism. The estimated lift force can be communicated to the user, e.g., presented on an electronic display, and the user can continue adjustment of the lift force, if needed, to substantially balance the lift force with the weight of the components coupled to the assembly.

7 Claims, 11 Drawing Sheets

(58) Field of Classification Search
USPC ..... 108/147, 50.01, 50.02
See application file for complete search history.

(56) References Cited

U.S. PATENT DOCUMENTS

| | | | | |
|---|---|---|---|---|
| 4,591,772 | A | 5/1986 | Hollow | |
| 5,236,416 | A | 8/1993 | Mcdaniel et al. | |
| 5,323,695 | A * | 6/1994 | Borgman | A47B 9/00 108/147 |
| 5,884,882 | A * | 3/1999 | Nada | G03G 15/00 211/207 |
| 6,078,249 | A * | 6/2000 | Slavik | H01C 10/40 338/180 |
| 7,439,694 | B2 * | 10/2008 | Atlas | A47B 9/04 318/560 |
| 7,551,970 | B2 | 6/2009 | Stommen et al. | |
| 8,286,927 | B2 * | 10/2012 | Sweere | F16M 13/02 248/920 |
| 8,967,560 | B2 * | 3/2015 | Ergun | A47B 21/02 248/404 |
| 9,038,549 | B1 * | 5/2015 | Zebarjad | A47B 9/12 108/147 |
| 9,167,894 | B2 | 10/2015 | Desroches et al. | |
| 9,360,152 | B2 * | 6/2016 | Sweere | A47B 9/20 |
| 9,978,485 | B2 * | 5/2018 | Wang | H01C 10/30 |
| 2013/0200579 | A1 * | 8/2013 | Abernethy | B62B 3/001 280/6.15 |
| 2013/0256489 | A1 | 10/2013 | Ergun et al. | |
| 2014/0096706 | A1 | 4/2014 | Labrosse et al. | |
| 2014/0137773 | A1 * | 5/2014 | Mandel | G06Q 10/109 108/50.11 |
| 2016/0015167 | A1 * | 1/2016 | Abu-Akel | A47B 21/02 248/161 |
| 2018/0360208 | A1 * | 12/2018 | Liao | A47B 21/02 |
| 2019/0025860 | A1 * | 1/2019 | Kollreider | A47B 9/04 |
| 2019/0269236 | A1 | 9/2019 | Lindblad et al. | |

FOREIGN PATENT DOCUMENTS

| | | | |
|---|---|---|---|
| CN | 114650751 | A | 6/2022 |
| JP | 3676482 | B2 | 3/1996 |
| WO | WO-2016183342 | A1 | 11/2016 |
| WO | WO-2018210386 | A1 | 11/2018 |
| WO | WO-2021086849 | A1 | 5/2021 |

OTHER PUBLICATIONS

"International Application Serial No. PCT/US2020/057523, Written Opinion dated Jan. 26, 2021", 4 pgs.

"International Application Serial No. PCT/US2020/057523, International Preliminary Report on Patentability dated May 12, 2022", 6 pgs.

"German Application Serial No. 112020005185.4, Office Action dated Oct. 20, 2022", w/o English Translation, 6 pgs.

* cited by examiner

SYSTEMS AND METHODS FOR LIFT FORCE ESTIMATION

CLAIM OF PRIORITY

This patent application is a U.S. NSPCT Application claiming the benefit of priority to PCT Application Serial No. PCT/US2020/057523, entitled "SYSTEM ANI) METHODS FOR LIFT FORCE ESTIMATION," filed on Oct. 27, 2020, and published as WO 2021/086849 A1 on May 6, 2021, which claims the benefit of priority of Walls, et al. U.S. Provisional Patent Application Ser. No. 62/926,715, entitled "SYSTEM AND METHODS FOR LIFT FORCE ESTIMATION," filed on Oct. 28, 2019, which are hereby incorporated by reference herein in their entirety.

TECHNICAL FIELD

This document pertains generally, but not by way of limitation, to devices that can move equipment such as electronic displays, keyboards, and other items between multiple positions relative to an operator.

BACKGROUND

A workstation can include a frame and a work surface. In some examples, the work surface can be height adjustable relative to the frame. For instance, a user can selectively adjust the height of the work surface with respect to the frame to accommodate user's varying postures during the use of the workstation. Ease of height adjustment can facilitate more frequent adjustment of the work surface.

The workstation can include a weight counterbalance mechanism having an energy storage device (e.g., spring, or the like) to provide lift assist for the user during the height adjustment. The weight counterbalance mechanism can lift at least a portion of the weight coupled to the work surface. The counterbalance mechanism can further include a lift force estimating module to determine the lift force and to inform the user to better match the lift force with the weight of the work surface.

BRIEF DESCRIPTION OF THE DRAWINGS

The following drawings are illustrative of particular non-limiting example configurations of the present invention and therefore do not limit the scope of the invention. The drawings are not to scale and are intended for use in conjunction with the explanations in the following detailed description. Example configurations of the present invention will hereinafter be described in conjunction with the appended drawings. The drawings illustrate generally, by way of example, but not by way of limitation, various configurations discussed in the present document.

OVERVIEW

This disclosure describes various systems and methods to estimate a lift force of a height adjustable assembly, e.g., workstation, using a potentiometer or other position sensor coupled to a counterbalance mechanism. The estimated lift force can be communicated to a user, e.g., presented on an electronic display, and the user can continue adjustment of the lift force, if needed, to substantially balance the lift force with the weight of the components coupled to the height adjustable portion of the workstation.

DETAILED DESCRIPTION

The following detailed description is illustrative in nature and is not intended to limit the scope, applicability, or configuration of the invention in any way. Rather, the following description provides some practical illustrations for implementing various configurations of the present invention. Examples of constructions, materials, dimensions, and manufacturing processes are provided for selected elements, and all other elements employ that which is known to those of ordinary skill in the field of the invention. Those skilled in the art will recognize that many of the noted examples have a variety of suitable alternatives.

The present inventors have recognized that it can be desirable for the user of a height adjustable assembly, e.g., workstation, to be able to adjust the lift force such that the lift force is substantially the same as a known weight of the components coupled to a portion of the assembly. Generally, the user of the assembly knows the combined weight of all the components coupled to the assembly, e.g., electronic display, computer, etc. Using various systems and methods described below, the lift force can be estimated using a potentiometer or other position sensor coupled to a counterbalance mechanism. The estimated lift force can be communicated to the user, e.g., presented on an electronic display, and the user can continue adjustment of the lift force, if needed, to substantially balance the lift force with the weight of the components coupled to the assembly.

Figure 1:
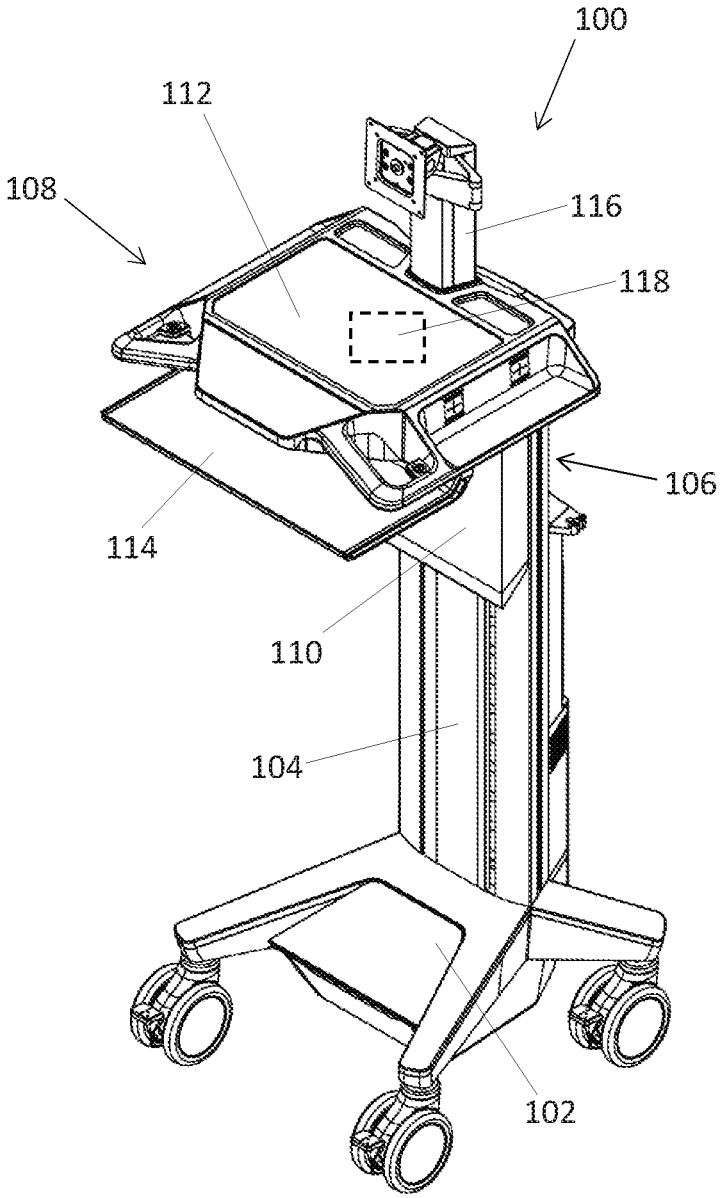
FIG. 1 depicts an example of a height adjustable mobile workstation that can implement various techniques of this disclosure.

FIG. 1 depicts an example of a height adjustable assembly that can implement various techniques of this disclosure. The techniques of this disclosure are not limited to the specific height adjustable assembly shown in FIG. 1, e.g., a height adjustable mobile workstation. Rather, the techniques of this disclosure are applicable to other height adjustable assemblies including (but not limited to) stationary desks, tables, wall mounted workstations, and other configurations with movable components, for example. The techniques of this disclosure are applicable to any type of height adjustable assembly.

The assembly 100 of FIG. 1 can include a base 102 and a support column 104 (e.g., a fixed-height riser, a telescoping riser, or the like j coupled to the base 102. A moving bracket (shown at 106 in FIG. 2) can be slidably engaged with the support column. A head unit assembly 108 and a cable storage box 110 can be coupled to the moving bracket.

A counterbalance mechanism 115 (shown in FIG. 2) can be coupled between the support column 104 and the moving bracket (shown at 106 in FIG. 2), The counterbalance mechanism can provide height adjustment for the moving bracket. The distance between the base 102 and the head unit assembly 108 can be selectively adjusted by translating the moving bracket with respect to the base 102 along a portion of the support column 104.

The head unit assembly 108 can include a worksurface 112, and a keyboard tray 114 can be located below the worksurface 112. A display mounting assembly including a display mounting riser 116 can be coupled to the assembly 100. A display (not depicted) can be coupled to the display mounting riser 116 to position it above the worksurface 112. In some configurations, a drawer housing 117 can be coupled to the assembly 100.

A controller 118 can be located within the head unit assembly 108. In some examples, the controller 118 can be a pre-programmed hardware element (e.g., application specific integrated circuit (ASIC), field programmable gate array (FPGA), digital signal processors (DSP), or other related component. As described in more detail below, the controller 118 can be used, among other things, to adjust the height of the workstation and can be used to determine various parameters used for lift force estimation, e.g., spring deflection, etc.

Figure 2:
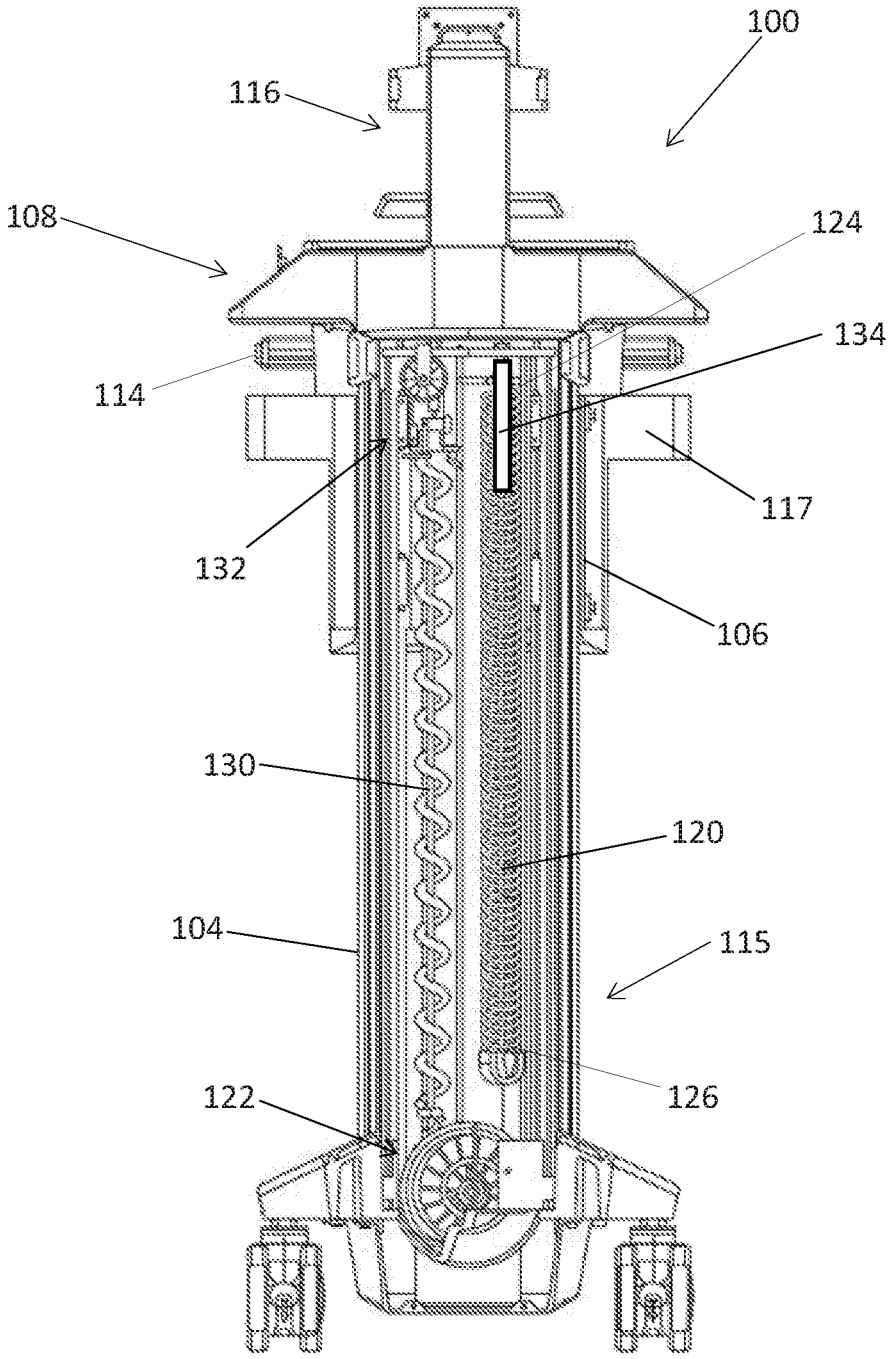
FIG. 2 is a partial rear cutaway rear view of the workstation of FIG. 1.

FIG. 2 is a partial cutaway rear view of the workstation of FIG. 1. A counterbalance mechanism 115 can be located inside the support column 104. The counterbalance mechanism 115 can include an extension spring 120 or other energy storage member, such as a compression spring or gas strut, and a wheel assembly 122 having a cam and a wheel coupled to each other. The wheel assembly 122 can be coupled to the support column 104.

The counterbalance mechanism 115 can be operatively coupled to the support column 104 and to the moving bracket 106. The counterbalance mechanism 115 can provide lift assist for at least a portion of the total weight of various components coupled to the head unit assembly 108 (e.g., head unit assembly 108, display mounting riser 116, display, keyboard, drawer housing, drawers and their content, and other medical equipment located on the worksurface) throughout the height adjustment.

The extension spring can have a first end 124 and a second end 126. The first end 124 of the extension spring 120 can be coupled to the support column 104 and the second end 126 of the extension spring can be operationally coupled to the wheel assembly 122. In some examples, the extension spring 120 can generally have a constant coil diameter along its length. In other example configurations, one or more coils, e.g., coils proximate the first end 124 of the spring, can have a smaller coil diameter.

Figure 3:
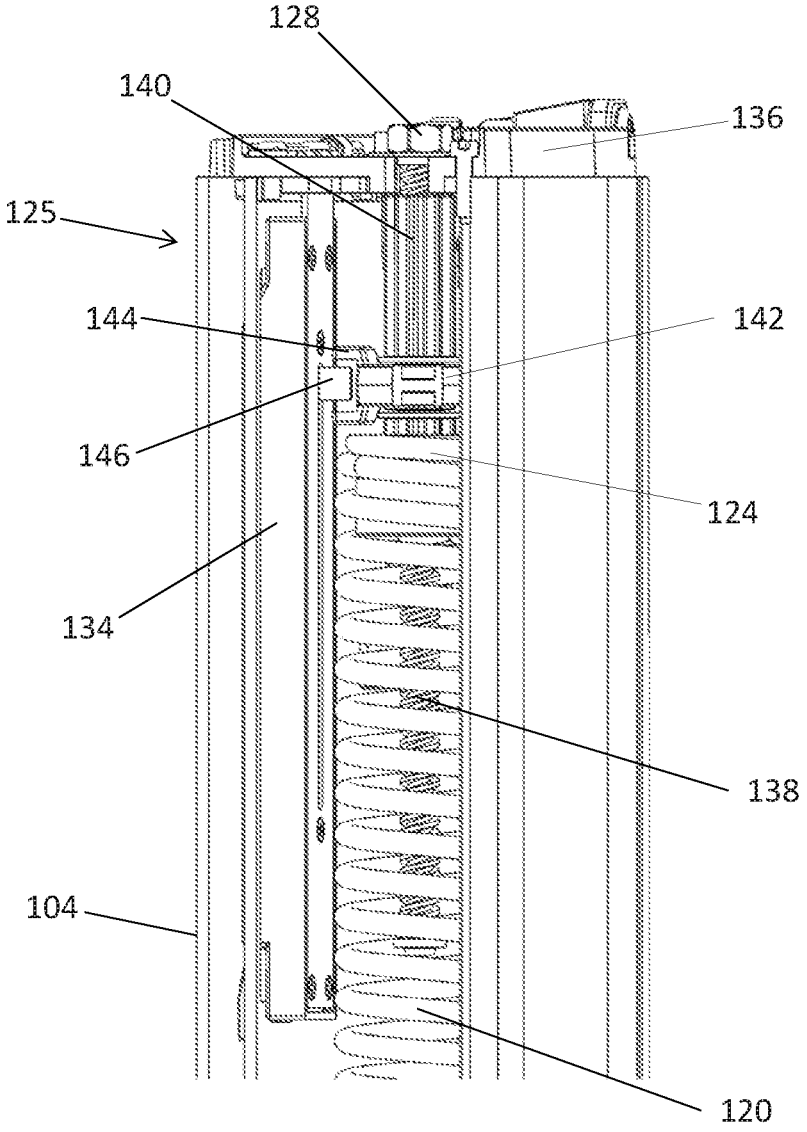
FIG. 3 shows a cut-away view of the upper end of the support column.

In some example configurations, an adjustment mechanism 125 can be coupled between the support column 104 and the first end 124 of the extension spring 120 as illustrated in FIG. 3. The adjustment mechanism 125 can include an adjustment screw 138 having a screw head 128, an elongated block 140, and a brace 142. The adjustment mechanism 125 can be used to adjust the tension on the extension spring 120.

A tensile member (not shown in FIG. 2) can be coupled between the wheel assembly 122 and the moving bracket 106. When the moving bracket 106 is displaced, the tensile member can rotate the wheel assembly 122, which can extend the extension spring 120 to provide a counterbalance lift force. The counterbalance lift force can provide lift assist for at least a portion of the combined weight of components coupled to the moving bracket 106.

In some examples, a lock mechanism can be contained inside the support column 104. The lock mechanism can include a lock rod 130 and a lock assembly 132. The lock rod 130 can be coupled to the support column 104. The lock assembly can be coupled to the moving bracket 106 and the lock assembly can be slidingly engaged with the lock rod 130. The lock assembly 132 can be biased to clamp on to the lock rod 130 to immobilize the moving bracket 106. A user of the workstation can selectively release the lock assembly 132 and allow it to slide along the lock rod 130 to adjust a height of the head unit assembly.

A potentiometer 134 (or other type of position sensor, such as an optical position sensor) can be coupled to the support column 104 and to the first end 124 of the extension spring 120. The potentiometer 134, e.g., slide potentiometer, can detect the amount of movement of the first end 124 of the extension spring 120 as the adjustment mechanism 125 adjusts the spring tension.

FIG. 3 shows a cut-away view of the upper end of the support column. A top bracket 136 can be fixedly attached to the upper end of the support column 104. The adjustment mechanism 125 can be coupled to the top bracket via an adjustment screw 138.

The adjustment screw 138 can be inserted through an aperture located on the top bracket 136. The screw head 128 can be located on the upper surface of the top bracket 136. The screw 138 can be at least partially located inside the extension spring 120, and the extension spring 120 can be operationally coupled to the adjustment screw 138. The potentiometer 134 can be attached to the support column 104 near the upper end of the support column 104. The potentiometer 134 can include a slide bar 146.

Figure 6:
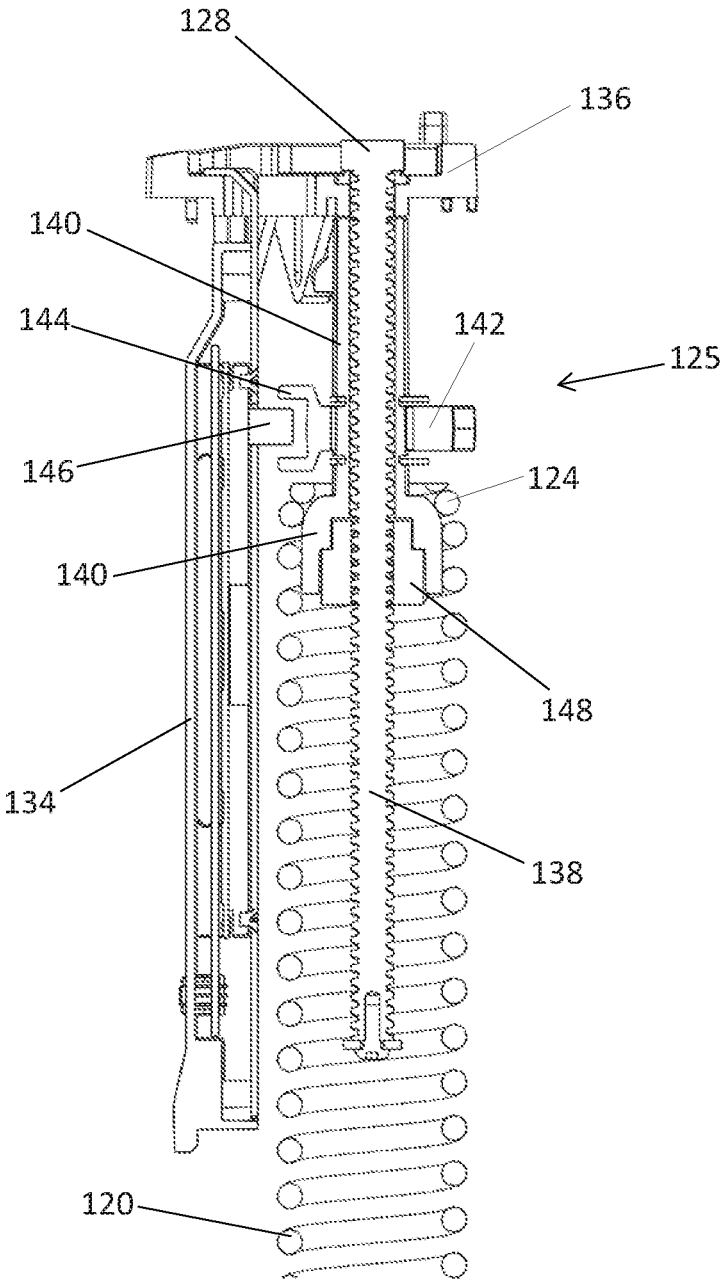
FIG. 6 is a cross-sectional view of the adjustment mechanism of FIG. 3 and shows the adjustment mechanism in an extended configuration of the extension spring.
Figure 7:
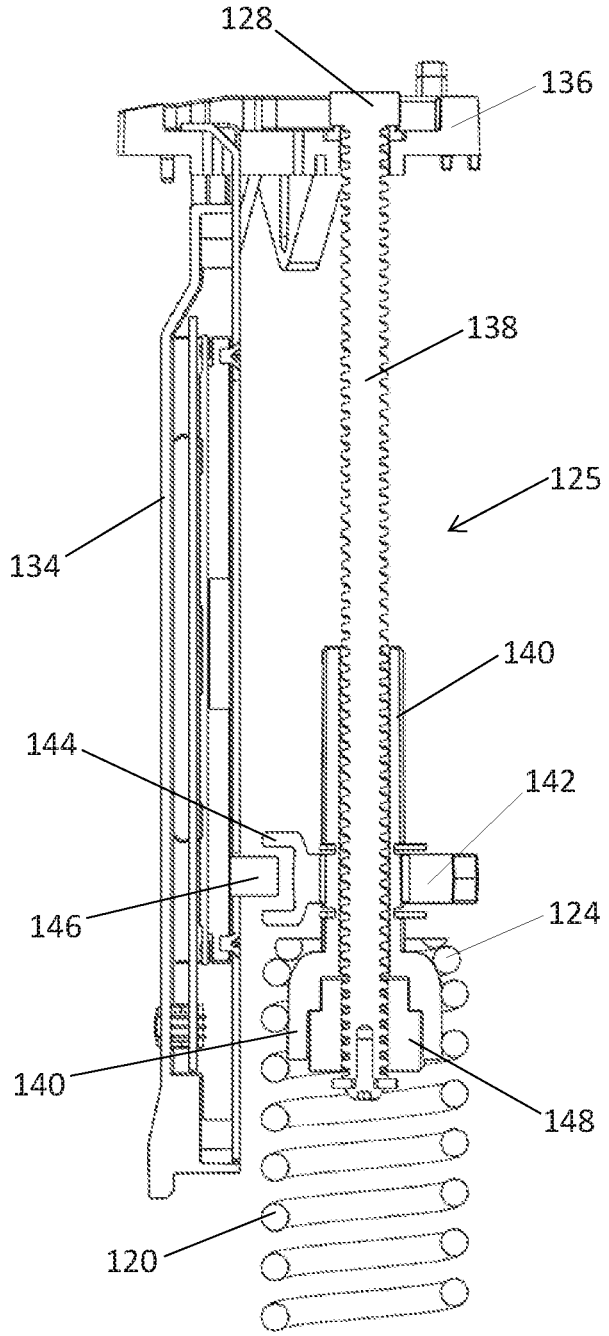
FIG. 7 is a cross-sectional view of the adjustment mechanism of FIG. 3 and shows the adjustment mechanism in a contracted configuration of the extension spring.

An elongated block 140 can be coupled to the first end of the extension spring 120. The elongated block 140 can include an upper end and a lower end. The lower end of the elongated block 140 can be at least partially located inside the extension spring 120. In some examples, a cross-section of the elongated block 140 proximate the lower end of the elongated block 140 can be larger than the inside diameter of one or more coils located at the upper end of the extension spring 120, as shown in FIGS. 6-7. Therefore, lower end of the elongated block 140 can be contained inside the extension spring 120, and the elongated block 140 can be used to stretch the extension spring 120 using the adjustment mechanism 125.

Figure 4:
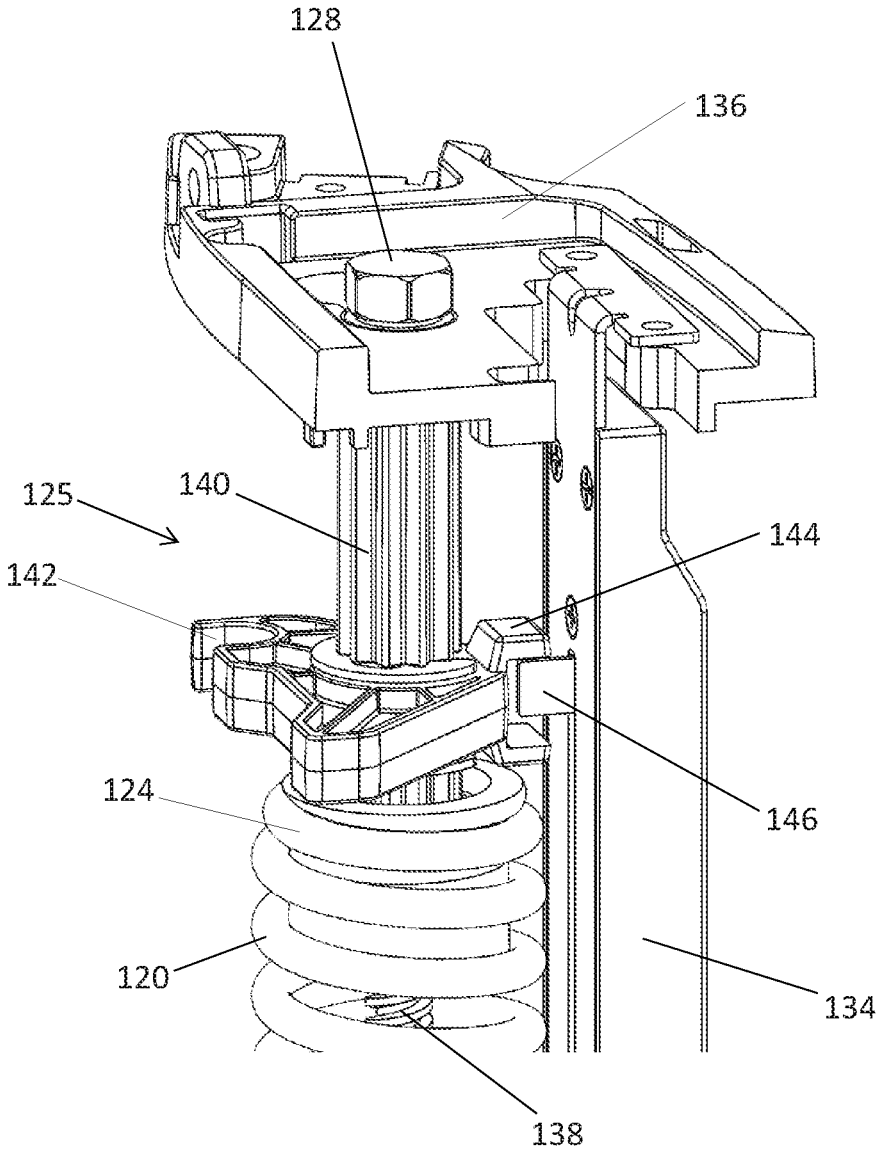
FIG. 4 is an enlarged, perspective view of the adjustment mechanism of FIG. 3.

A brace 142 can be coupled to the elongated block 140. The brace 142 can be shaped such that it can guide the first end of the extension spring 120 during the adjustment of the spring tension. An example of an outer contour of the brace 142 is shown in FIG. 4. The brace 142 can be keyed to the elongated block 140, and the brace 142 can contact the support column 104 on its outer contour. Therefore, the brace 142 can prevent the elongated block 140 from rotating, and the brace allows it to move in an axial direction of the elongated block.

As seen in FIG. 3, the brace 142 can include a pair of tabs 144. The tabs 144 can be located above and below the slide bar 146 of the potentiometer 134 in an assembled configuration, such as shown in FIGS. 3-7. During an adjustment of the spring tension, the tabs 144 can move the slide bar 146 in relation to the first end of the extension spring 120.

FIG. 4 is an enlarged, perspective view of the adjustment mechanism 125 of FIG. 3. FIG. 4 depicts the connection between the adjustment mechanism 125 and the potentiometer. As seen in FIG. 4, the tabs 144 of the brace 142 can be located above and below the slide bar 146 of the potentiometer 134. As the adjustment screw head 128 is turned, the adjustment screw 138 turns, which causes the brace 142 to move along the length of the screw 138. As the brace 142 moves, e.g., downward, the topmost one of tabs 144 contacts the slide bar 146 of the potentiometer. As the slide bar moves, e.g., downward, the slide bar 146 (e.g., the wiper of the potentiometer) moves, causing a change in an output voltage between a first electrical contact coupled to the wiper and a second electrical contact of the potentiometer. In this manner, a change in the position of the slide bar 146, which corresponds to a change in position of an end of the extension spring 120, results in a change in an output voltage.

Figure 5:
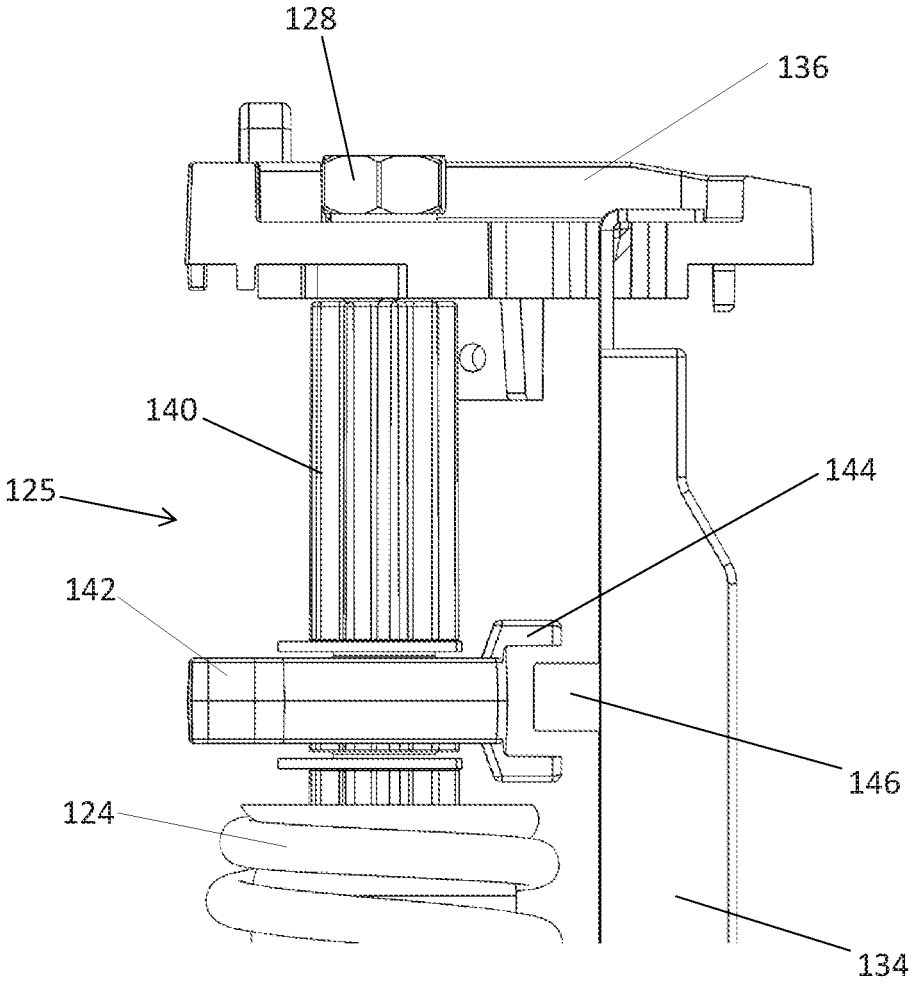
FIG. 5 is an enlarged, side view of the adjustment mechanism of FIG. 3.

FIG. 5 is an enlarged, side view of the adjustment mechanism 125 of FIG. 3. FIG. 5 depicts the connection between the adjustment mechanism 125 and the potentiometer.

FIGS. 6 and 7 are cross-sectional views of the adjustment mechanism 125 of FIG. 3. FIG. 6 shows the adjustment mechanism 125 in an extended configuration of the extension spring and FIG. 7 shows the adjustment mechanism 125 in a contracted configuration of the extension spring. FIGS. 6 and 7 will be described together for purposes of conciseness.

As seen in FIGS. 6-7, in some examples, the elongated block 140 can have a hole at its center. The hole can extend through the length of the elongated block from its upper end to the lower end. A nut 148 can have a threaded hole at its center and can be coupled to the elongated block 140 adjacent its lower end.

In some examples, the nut 148 can be keyed to the elongated block 140. Therefore, the nut 148 cannot move or rotate relative to the elongated block 140, but it can move together with the elongated bloCk 140 during the adjustment of the spring tension. The adjustment screw 138 can be inserted through the hole located on the block 140 and the screw 138 can engage the nut 148.

To adjust the tension, the user of the workstation can rotate the adjustment screw 138, e.g., by engaging a wrench with the screw head 128. When the adjustment screw 138 is rotated, the nut/block assembly, which cannot rotate, can instead move in a direction parallel to the axial direction of the adjustment screw 138. As a result, the first end of the extension spring 120 can move up or down together with the elongated block 140.

When the elongated block 140 moves towards the top bracket 136, as shown in FIG. 6, the elongated block 140 can pull the first end of the extension spring 120 to put the spring in an extended configuration. The spring tension can be increased in the extended configuration to assist lifting heavier components coupled to the head unit assembly (shown in FIG. 1).

When the elongated block 140 moves away from the top bracket 136, as shown in FIG. 7, the extension spring 120 relaxes to put the extension spring 120 in a contracted configuration. The spring tension can be decreased in the contracted configuration to assist lifting lighter components coupled to the head unit assembly (shown in FIG. 1).

During the adjustment of the spring tension, the tabs 144 located on the brace 142 can engage with the slide bar 146 and move the slide bar along the length of the potentiometer 134. The potentiometer 134 can be connected to the controller 118 of FIG. 1. The potentiometer 134 can send a signal to the controller 118, such as an output voltage based on the position of the slide bar. As described in detail below, the controller 118 can determine a position of the first end of the extension spring 120 using the signal, e.g., output voltage. Then, the controller 118 can determine an amount of tension on the extension spring, and correlate it to a lift force based on a pre-programmed logic, for example.

Figure 8:
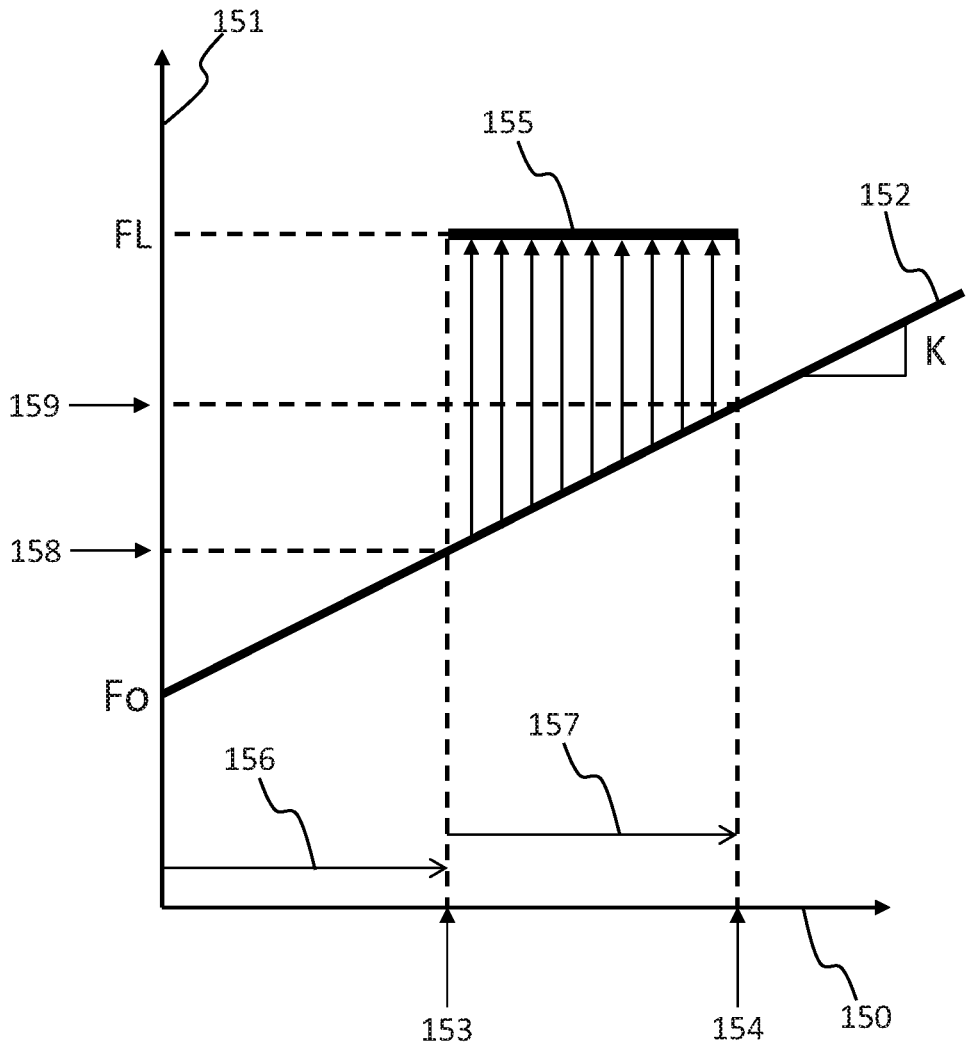
FIG. 8 is a graph depicting an example of force variation in a counterbalance mechanism.

FIG. 8 is a graph depicting an example of force variation in a counterbalance mechanism. The x-axis 150 represents spring deflection and the y-axis 151 represents force. An extension spring force 152 can be characterized by an initial tension (Fo) and spring stiffness (K). At any spring deflection, the spring force can be calculated according to Equation 1 (below):

$$\text{(Spring force)}=\text{(Initial tension)}+\text{(spring stiffness)}\times\text{(spring deflection)} \quad \text{Eq. 1}$$

As apparent from Equation 1 and as illustrated in FIG. 8, the spring force 152 can increase linearly as the spring deflection increases from an initial spring deflection 153 to a final spring deflection 154.

In a weight counterbalance mechanism, it can be desirable for a lift force 155 (FL as shown in FIG. 8) to be substantially constant and equal to the weight to be lifted. The counterbalance mechanism 115 of FIG. 2 can convert the increasing spring force 152 into a substantially constant lift force 155.

The user of the workstation of FIGS. 1-2 can adjust the tension on the extension spring using the adjustment mechanism 125, which can be coupled to the first end of the extension spring 120. Using the adjustment mechanism 125, the user can move the first end of the spring as described above with respect to FIGS. 6-7. A first spring deflection 156 (e.g., movement of the first end of the spring 124) can adjust the initial spring deflection 153, as illustrated in FIG. 8, for example it increases the spring tension from zero to the desired initial spring deflection 153.

The second end of the spring can be operationally coupled to the cam/wheel assembly, e.g., cam/wheel assembly 122 of FIG. 2, During the height adjustment, the cam/wheel assembly can rotate and pull the second end of the spring. A second spring deflection 157 (e.g., movement of the second end of the spring 126) toward the final spring deflection 154 to increase the spring tension, as illustrated in FIG. 8. An initial spring force 158 and a final spring force 159 corresponding to the initial spring deflection 153 and to the final spring deflection 154, respectively, can be calculated using the Equation 1.

The cam/wheel assembly, e.g., cam/wheel assembly 122 of FIG. 2, can convert the increasing spring force to a substantially constant lift force as illustrated in FIG. 8. The cam/wheel assembly can be operationally coupled to the head unit assembly. The cam/wheel assembly of the counterbalance mechanism 115 can provide a lift assist for the head unit assembly using this substantially constant lift force.

The present inventors have recognized that it can be desirable for the user of the workstation to be able to adjust the lift force such that the lift force is substantially the same as the known combined weight of the components coupled to the head unit assembly. Generally, the user of the workstation knows the weight of all the components coupled to the head unit assembly, e.g., electronic display, computer, etc. Using various techniques of this disclosure, the lift force can be estimated using a potentiometer or other position sensor, such as, but not limited to, an optical position sensor, coupled to a counterbalance mechanism. The estimated lift force can be communicated to the user, e.g., presented on an electronic display, and the user can continue adjustment of the lift force, if needed, to substantially balance the lift force with the combined weight of the components coupled to the head unit assembly.

As described above, a potentiometer or other position sensor can be coupled to the support column. For example, the potentiometer 134 can be coupled to the first end of the extension spring 120, as shown in FIGS. 6-7. The potentiometer 134 can be electrically connected to the controller 118 of FIG. 1. The controller 118 can control application of a voltage, e.g., via a separate voltage source (not depicted), across two terminals of the potentiometer. As the position of the slide bar 146 changes in response to movement of the first end of the extension spring, a third terminal (e.g., wiper) of the potentiometer coupled to slide bar 146 moves and changes the output voltage of the potentiometer 134. A signal corresponding to the output voltage of the potentiometer, which corresponds to the position of the first end of the extension spring, can be transmitted to the controller 118. In this manner, the controller 118 of FIG. 1 can use the potentiometer to detect the movement and relative position of the first end of the extension spring 120 in reference to the support column 104.

For a linear potentiometer with a straightforward mechanical motion, e.g., translation of the slide bar 146 of FIGS. 6-7, the formula to correlate the output voltage of the potentiometer to the translation amount is the equation for a line, as shown below in Equation 2:

$$y=mx+b \qquad \text{Eq. 2}$$

The voltage (x) can correspond to the signal transmitted to the controller 118 of FIG. 1 from the potentiometer 134. The voltage can be multiplied by a scaling constant (m) and an offset constant (b) can be added to calculate the corresponding amount of translation or distance (y).

The scaling and offset constants (m and b, respectively) can be determined by measuring the voltage at two known distances (e.g., a first distance where the slide bar 146 is at a first position, and a second distance where the slide bar 146 is at a second position). The controller 118 can substitute the voltage and the distance values for x and y, respectively, in Equation 2 to obtain two equations. By solving these two equations with two unknowns (e.g., m and b), the controller 118 can determine the scaling and offset constants (m and b).

Figure 9:
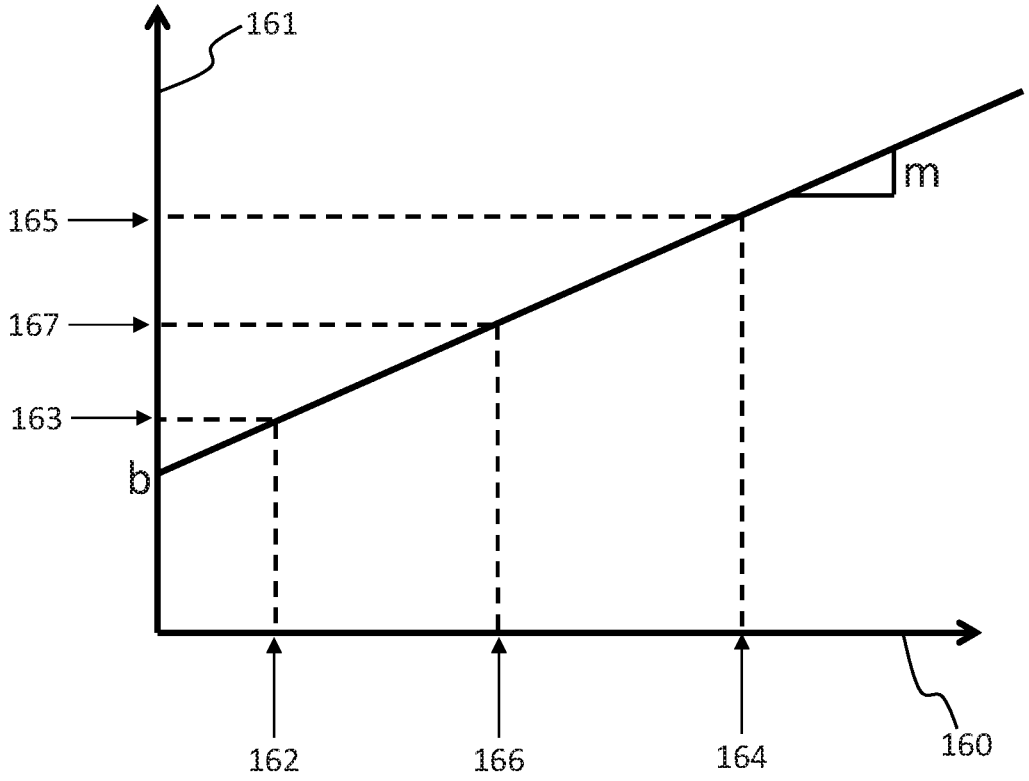
FIG. 9 is a graph depicting an example of a spring deflection calculation using a potentiometer.

FIG. 9 is a graph depicting an example of a spring deflection calculation using a potentiometer. The x-axis 160 represents the output voltage of the potentiometer and the y-axis 161 represents the spring deflection due to tension adjustment.

Once the controller 118 (of FIG. 1) determines the amount of translation (y) of the first end of the spring, the controller 118 can convert the translation (y) to a spring deflection (6) by comparing the translation (y) to the free length of the spring. Therefore, a set of data pairs at two distances can be determined.

For example, the controller 118 can determine a first data pair (e.g., a first voltage V1 (as shown at 162) and a first spring deflection δ1 (as shown at 163)) at the first distance when the slide bar is at the first position, and a second data pair (e.g., a second voltage V2 (as shown at 164) and a second spring deflection δ2 (as shown at 165)) at the second distance when the slide bar is at the second location, as shown in FIG. 9. During the tension adjustment, e.g., manually by the user or automatically by a motor, the controller 118 can determine a spring deflection 6S (as shown at 167) at a voltage V (as shown at 166) generated by the potentiometer, as shown in FIG. 9.

Figure 10:
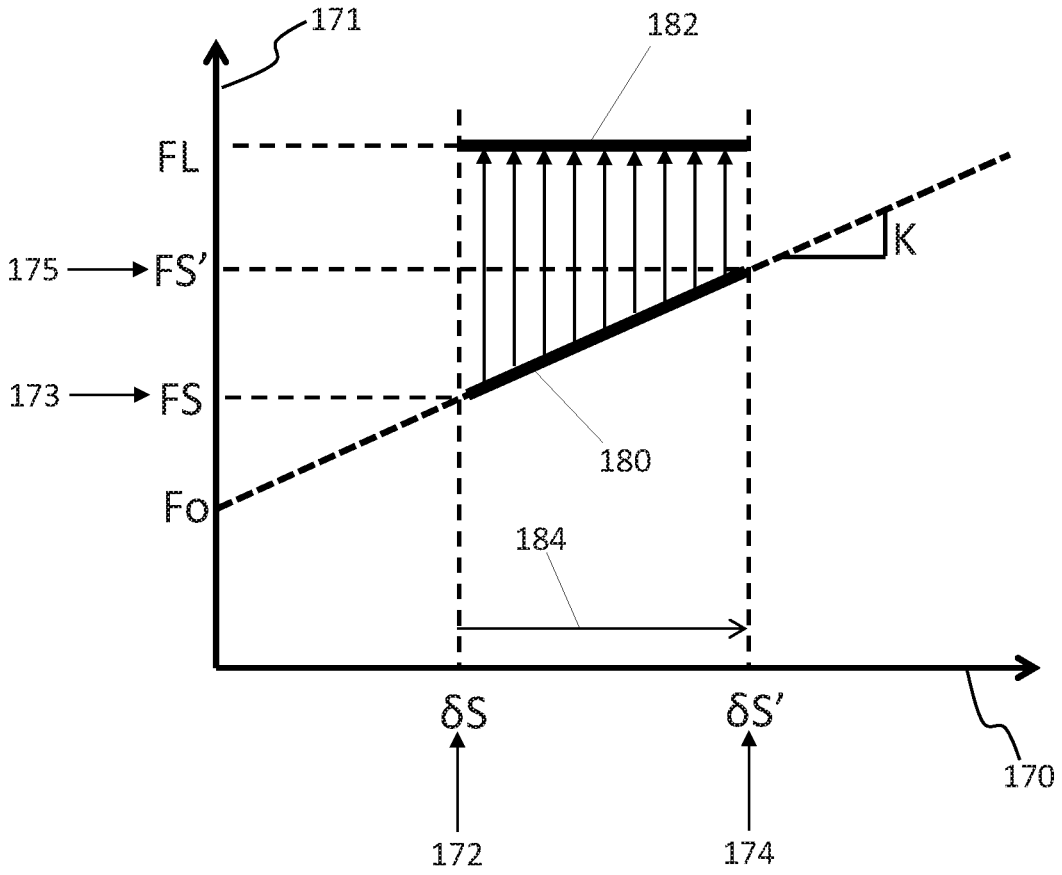
FIG. 10 is a graph depicting an example of a force calculation in a counterbalance mechanism.

FIG. 10 is a graph depicting an example of a force calculation in a counterbalance mechanism. The x-axis 170 represents spring defection (δ) and the y-axis 171 represents lift force or spring force (F).

Once the spring deflection δS (as shown at 172) is determined, as described above with respect to FIG. 9, the spring force or lift force FS (as shown at 173) can be calculated using the initial tension (Fo) and the spring stiffness (K) according to Equation 1. During the height adjustment, the second end of the spring can be pulled by the cam/wheel assembly, as described above with respect to FIG. 8, to increase the spring deflection to δS' (as shown at 174). Because of the increase in the spring tension A (as shown at 184) due to height adjustment, the spring force increases linearly to FS' (as shown at 175), as shown in FIG. 10.

The cam/wheel assembly (and particularly the cam profile) can convert the increasing spring force (as shown at 180) generated by the extension spring (e.g., the spring force increases from FS (as shown at 173) to FS' (as shown at 175) during the height adjustment) to a substantially constant lift force FL (as shown at 182). The substantially constant lift force 182 can be used to provide lift assist for the head unit assembly during height adjustment, as described above with respect to FIG. 8. Additional information regarding this conversion can be found in commonly assigned U.S. Pat. No. 8,286,927 to Sweere et al., which is incorporated by reference in its entirety, particularly column 6, lines 28-40 and column 9, lines 45-67.

As illustrated in FIG. 10 and as discussed above, a voltage V generated by the potentiometer 134 can be converted to a substantially constant lift force FL through a series of calculations performed by the controller 118. The controller 118 can generate an output to the user (e.g., presented on a display on a resident computer screen) indicating the amount of lift force determined. If the user is not satisfied with the lift force determined (e.g., the lift force does not match the combined weight of components coupled to the head unit assembly), the user can continue adjusting the spring tension as described above with respect to FIGS. 6-7 until a desired lift force is reached.

In some examples, the lift force FL can be measured directly (e.g., using a force sensor coupled to the head unit assembly, or the like). Instead of measuring the voltage and converting it to a spring deflection and then calculating the lift force, as discussed above, the voltage and the lift force can be measured and correlated directly as illustrated in FIG. 11.

Figure 11:
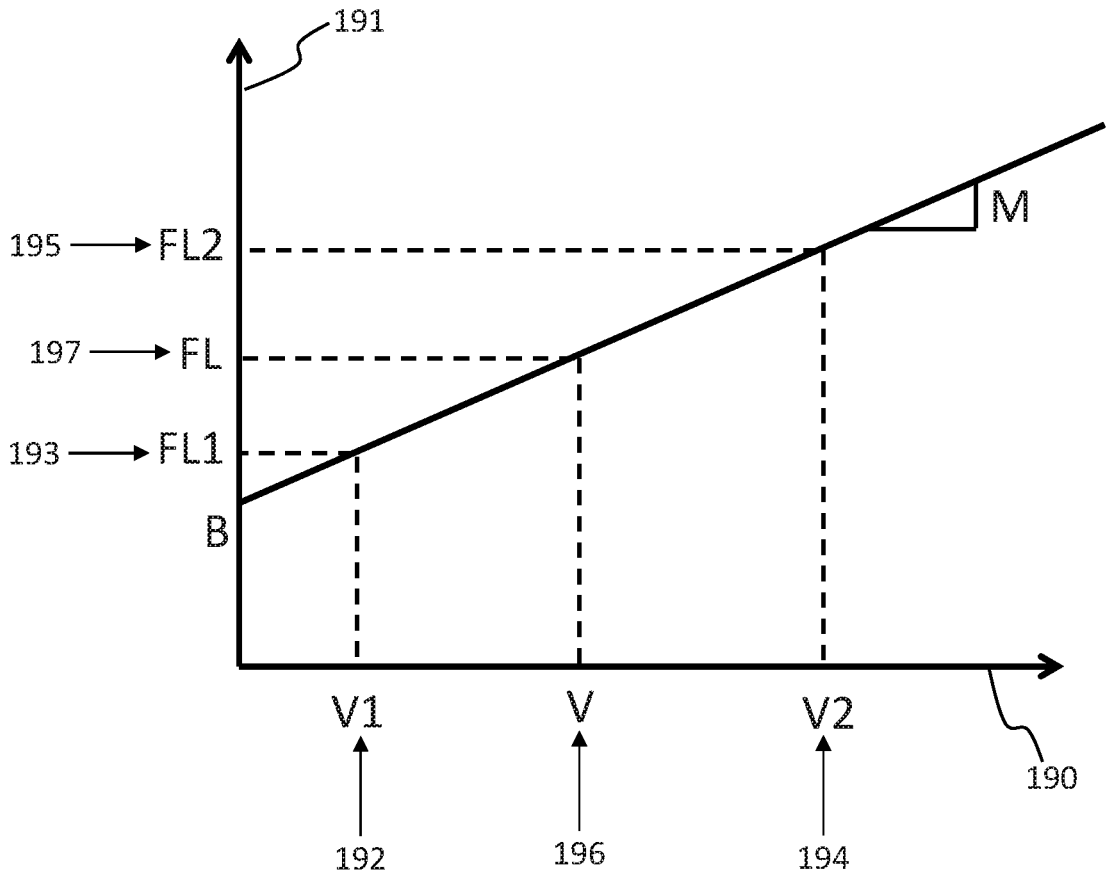
FIG. 11 is a graph depicting another example of a force calculation in a counterbalance mechanism.

FIG. 11 is a graph depicting another example of a force calculation in a counterbalance mechanism. The x-axis 190 represents the output voltage of the potentiometer and the y-axis 191 represents lift force (F). At two instances (e.g., a first instance where the slide bar of the potentiometer is at a first location, and a second instance where the slide bar is at a second location), the voltage and the lift force can be measured via the potentiometer and a force sensor, respectively. For example, a force sensor can be coupled to the tensile member connecting the cam/wheel assembly to the moving bracket.

For example, at the first instance, the voltage and the lift force measurements can be V1 (as shown at 192) and F1 (as shown at 193), respectively, and at the second instance, the voltage and the lift force can be V2 (as shown at 194) and F2 (as shown at 195), respectively. Using the line equation for these two instances, a scaling and an offset constants (M and B, respectively) can be calculated as illustrated in FIG. 11. Then, using the line equation y=Mx+B, the lift force FL (as shown at 196) can be calculated for a measured voltage V (as shown at 197) as illustrated in FIG. 11.

The controller 118 can generate an output to the user (e.g., display on a resident computer screen) indicating the amount of lift force determined. If the user is not satisfied with the lift force determined (e.g., the lift force does not match the combined weight of components coupled to the head unit assembly), the user can continue adjusting the spring tension as described above with respect to FIGS. 6-7 until a desired lift force is reached.

Although described above with respect to manual tension adjustment, the lift force estimation techniques of this disclosure are not so limited. Rather, in some examples, the tension adjustment can be performed automatically by the workstation.

For example, a shaft of an electric motor can be mechanically coupled to the adjustment screw, e.g., of FIGS. 6-7, in addition, the assembly of FIG. 1 can include one or more weight sensors, e.g., coupled to the base 102 or other portion of the assembly 100, to determine a total weight of various components coupled to the head unit assembly 108, e.g., electronic display, computer, etc. The controller 118 can receive signals from the weight sensors and if the lift force determined by the controller 118, as described above, does not substantially match the detected weight, the controller 118 can output control signals to the electric motor. In response, the electric motor can turn the adjustment screw to adjust the spring tension of the extension spring until the lift force, as determined by the controller 118, substantially matches the detected weight.

In some example configurations, the controller can track the time when the lift force is adjusted. The controller can periodically (e.g., every three months after an adjustment is made, or more or less frequently) remind the user of the workstation to check the lift force in association with the weight of various components coupled to the head unit assembly. For example, if additional components are coupled to or decoupled from the head unit assembly after an adjustment was made to the lift force, the user of the workstation can be reminded to verify and correct the lift force adjustment accordingly to optimize the performance of the counterbalance mechanism.

In some other example configurations, the controller can also generate reports of the weight of components coupled to the head unit assembly, and lift force adjustment and timing to a cloud-based management software. The cloud-based management software can issue alerts to the user if an improper adjustment or long duration of non-adjustment is detected based on a pre-programmed logic. The cloud-based management software can issue audio visual alerts to the user's portable electronic device, send an email, or the like.

Additional Notes and Aspects

Aspect 1 may include or use subject matter (such as an apparatus, a system, a device, a method, a means for performing acts, or a device readable medium including instructions that, when performed by the device, may cause the device to perform acts), such as may include or use a height adjustable workstation configured to estimate a lift force, the workstation comprising: a height adjustable assembly configured to support a load; a counterbalance mechanism coupled to the height adjustable assembly and configured to provide a lift force to counterbalance the load, the counterbalance mechanism including an energy storage member; an adjustment mechanism coupled to the energy storage member and configured to adjust a tension of the energy storage member; a position sensor coupled to the energy storage member and configured to output a signal based on a position of the energy storage member; and a controller configured to receive the signal and estimate a lift force of the counterbalance mechanism.

Aspect 2 may include or use, or may optionally be combined with the subject matter of Aspect 1, to optionally include or use wherein the position sensor is a potentiometer.

Aspect 3 may include or use, or may optionally be combined with the subject matter of Aspect 2, to optionally include or use wherein the potentiometer is a slide potentiometer having a slide bar, the height adjustable assembly comprising: a brace coupled to the energy storage member and configured to couple to at least a portion of the slide bar when the adjustment mechanism adjusts the tension of the energy storage member.

Aspect 4 may include or use, or may optionally be combined with the subject matter of Aspect 3, to optionally include or use wherein the brace includes a pair of tabs, wherein at least one of the pair of tabs is configured to couple to the at least a portion of the slide bar when the adjustment mechanism adjusts the tension of the energy storage member.

Aspect 5 may include or use, or may optionally be combined with the subject matter of Aspect 1, to optionally include or use wherein the controller is configured to generate an output to the user that indicates the estimated lift force.

Aspect 6 may include or use, or may optionally be combined with the subject matter of Aspect 5, to optionally include or use wherein the output is displayed to the user.

Aspect 7 may include or use, or may optionally be combined with the subject matter of Aspect 1, to optionally include or use wherein the controller is configured to: determine an amount of translation of an end of the energy storage member determine a spring deflection using the determined amount of translation; and estimate the lift force using the determined spring deflection.

Aspect 8 may include or use subject matter (such as an apparatus, a system, a device, a method, a means for performing acts, or a device readable medium including instructions that, when performed by the device, may cause the device to perform acts), such as may include or use a method of determining a lift force of a height adjustable assembly configured to support a load, the method comprising: adjusting a tension of an energy storage member of a counterbalance mechanism configured to provide the lift force to counterbalance the load; generating, using a position sensor, a signal based on a position of the energy storage member; and determining the lift force using the signal.

Aspect 9 may include or use, or may optionally be combined with the subject matter of Aspect 8, to optionally further comprising: generating an output to a user that indicates the determined amount of lift force.

Aspect 10 may include or use, or may optionally be combined with the subject matter of Aspect 8, to optionally include or use wherein generating an output to the user that indicates the determined amount of lift force includes: displaying the lift force to a user.

Aspect 11 may include or use, or may optionally be combined with the subject matter of Aspect 8, to optionally include or use wherein determining the lift force using the signal includes: determining an amount of translation of an end of the energy storage member; determining a spring deflection using the determined amount of translation; and determining the lift force using the determined spring deflection.

Each of these non-limiting examples can stand on its own, or can be combined in any permutation or combination with any one or more of the other examples.

The above detailed description includes references to the accompanying drawings, which form a part of the detailed description. The drawings show, by way of illustration, specific examples in which the present subject matter can be practiced. These examples are also referred to herein as "examples." Such examples can include elements in addition to those shown or described. However, the present inventors also contemplate examples in which only those elements shown or described are provided. Moreover, the present inventors also contemplate examples using any combination or permutation of those elements shown or described (or one or more aspects thereof), either with respect to a particular example (or one or more aspects thereof), or with respect to other examples (or one or more aspects thereof) shown or described herein.

In the event of inconsistent usages between this document and any documents so incorporated by reference, the usage in this document controls.

In the following claims, the terms "including" and "comprising" are open-ended, that is, a system, device, article, composition, formulation, or process that includes elements in addition to those listed after such a term in a claim are still deemed to fall within the scope of that claim. Moreover, in the following claims, the terms "first," "second," "and third," etc. are used merely as labels, and are not intended to impose numerical requirements on their objects.

The above description is intended to be illustrative, and not restrictive. For example, the above-described examples (or one or more aspects thereof) may be used in combination with each other. Other examples can be used, such as by one of ordinary skill in the art upon reviewing the above description. The Abstract is provided to comply with 37 C.F.R. § 1.72(b), to allow the reader to quickly ascertain the nature of the technical disclosure. It is submitted with the understanding that it will not be used to interpret or limit the scope or meaning of the claims. Also, in the above Detailed Description, various features may be grouped together to streamline the disclosure. This should not be interpreted as intending that an unclaimed disclosed feature is essential to any claim. Rather, inventive subject matter may lie in less than all features of a particular disclosed example. Thus, the following claims are hereby incorporated into the Detailed Description as examples or configurations, with each claim standing on its own as a separate example, and it is contemplated that such examples can be combined with each other in various combinations or permutations. The scope of the present subject matter should be determined with reference to the appended claims, along with the full scope of equivalents to which such claims are entitled.

The claimed invention is:

1. A height adjustable workstation configured to estimate a lift force, the workstation comprising:

a height adjustable assembly configured to support a load;

a counterbalance mechanism coupled to the height adjustable assembly and configured to provide a lift force to counterbalance the load, the counterbalance mechanism including an energy storage member;

an adjustment mechanism coupled to the energy storage member and configured to adjust a tension of the energy storage member;

a position sensor coupled to the energy storage member and configured to output a signal based on a position of the energy storage member; and a controller configured to receive the signal and estimate a lift force of the counterbalance mechanism.

2. The height adjustable workstation of claim 1, wherein the position sensor is a potentiometer.

3. The height adjustable workstation of claim 2, wherein the potentiometer is a slide potentiometer having a slide bar, the height adjustable assembly comprising:

a brace coupled to the energy storage member and configured to couple to at least a portion of the slide bar when the adjustment mechanism adjusts the tension of the energy storage member.

4. The height adjustable workstation of claim 3, wherein the brace includes a pair of tabs, wherein at least one of the pair of tabs is configured to couple to the at least a portion of the slide bar when the adjustment mechanism adjusts the tension of the energy storage member.

5. The height adjustable workstation of claim 1, wherein the controller is configured to generate an output to a user that indicates the estimated lift force.

6. The height adjustable workstation of claim 5, wherein the output is displayed to the user.

7. The height adjustable workstation of claim 1, wherein the controller is configured to:

determine an amount of translation of an end of the energy storage member;

determine a spring deflection using the determined amount of translation; and estimate the lift force using the determined spring deflection.

* * * * *